US011189923B2

(12) United States Patent
Hsieh et al.

(10) Patent No.: US 11,189,923 B2
(45) Date of Patent: Nov. 30, 2021

(54) ANTENNA STRUCTURE AND WIRELESS COMMUNICATION DEVICE USING SAME

(71) Applicant: Chiun Mai Communication Systems, Inc., New Taipei (TW)

(72) Inventors: Wei-En Hsieh, New Taipei (TW); Chien-Hua Li, New Taipei (TW); Yih-Shyang Her, New Taipe (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 354 days.

(21) Appl. No.: 16/183,721

(22) Filed: Nov. 7, 2018

(65) Prior Publication Data

US 2019/0181549 A1 Jun. 13, 2019

(30) Foreign Application Priority Data

Nov. 22, 2017 (CN) ..... 201711175305.6

(51) Int. Cl.

| | |
|---|---|
| ***H01Q 1/24*** | (2006.01) |
| ***H01Q 5/30*** | (2015.01) |
| ***H01Q 5/10*** | (2015.01) |
| ***H01Q 5/328*** | (2015.01) |
| ***H01Q 1/38*** | (2006.01) |
| ***H01Q 1/36*** | (2006.01) |
| ***H01Q 5/371*** | (2015.01) |
| ***H01Q 5/378*** | (2015.01) |

(52) U.S. Cl.

CPC ..... *H01Q 5/30* (2015.01); *H01Q 1/243* (2013.01); *H01Q 1/36* (2013.01); *H01Q 1/38* (2013.01); *H01Q 5/10* (2015.01); *H01Q 5/328* (2015.01); *H01Q 5/371* (2015.01); *H01Q 5/378* (2015.01)

(58) Field of Classification Search

None

See application file for complete search history.

(56) References Cited

U.S. PATENT DOCUMENTS

| | | | | |
|---|---|---|---|---|
| 9,537,218 | B2 * | 1/2017 | Lin | H01Q 21/28 |
| 2003/0052824 | A1 * | 3/2003 | Ollikainen | H01Q 5/371 343/700 MS |
| 2007/0268143 | A1 * | 11/2007 | Copeland | H01Q 9/065 340/572.7 |

(Continued)

FOREIGN PATENT DOCUMENTS

| | | | |
|---|---|---|---|
| CN | 105633581 | A | 6/2016 |
| TW | 201501415 | A | 1/2015 |

*Primary Examiner* — Trinh V Dinh

(74) *Attorney, Agent, or Firm* — ScienBiziP, P.C.

(57) ABSTRACT

An antenna structure includes a radiating portion and a coupling portion. The radiating portion is electrically connected to a feed point for feeding current. The coupling portion is electrically connected to a ground point to be grounded. The coupling portion is spaced apart from the radiating portion. The radiating portion excites a first resonant mode for generating radiation signals in a first frequency band. The current flowing through the radiating portion is coupled to the coupling portion, and the coupling portion excites a second resonant mode and a third resonant mode for generating radiation signals in a second frequency band and a third frequency band. Frequencies of the first frequency band are higher than frequencies of the second frequency band. Frequencies of the third frequency band are higher than frequencies of the first frequency band.

15 Claims, 10 Drawing Sheets

(56) References Cited

U.S. PATENT DOCUMENTS

| | | | | |
|---|---|---|---|---|
| 2011/0012790 | A1* | 1/2011 | Badaruzzaman | H01Q 13/106 343/700 MS |
| 2013/0307731 | A1* | 11/2013 | Vanjani | H01Q 1/38 343/700 MS |
| 2014/0125528 | A1* | 5/2014 | Tsai | H01Q 1/243 343/702 |
| 2014/0375507 | A1* | 12/2014 | Lin | H01Q 5/371 343/700 MS |
| 2015/0097753 | A1* | 4/2015 | Liou | H01Q 5/40 343/867 |
| 2015/0200456 | A1* | 7/2015 | You | H01Q 5/321 343/722 |
| 2015/0263428 | A1* | 9/2015 | Liou | H01Q 5/371 343/702 |
| 2015/0270613 | A1* | 9/2015 | Toh | H01Q 9/0442 343/876 |
| 2016/0112113 | A1* | 4/2016 | Liou | H01Q 1/243 370/297 |
| 2016/0134017 | A1* | 5/2016 | Lin | H01Q 5/378 343/861 |
| 2017/0141470 | A1* | 5/2017 | Yong | H01Q 21/28 |
| 2018/0299929 | A1* | 10/2018 | Kim | G06F 1/1635 |

* cited by examiner

ANTENNA STRUCTURE AND WIRELESS COMMUNICATION DEVICE USING SAME

FIELD

The subject matter herein generally relates to an antenna structure and a wireless communication device using the antenna structure.

BACKGROUND

Currently, frequency bands that wireless communication devices need to support have increased, and the requirements for antenna bandwidth are also increasing. Usually, the antenna need to cover 2G/3G/4G frequency bands (700-960 MHz and 1710-2690 MHz). In addition, the wireless communication device mostly has a maximized screen and has a light and thin size. In this way, metallic components around the antenna are likely to cause a shielding effect on the antenna, thereby resulting in a decrease of antenna transmission efficiency.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
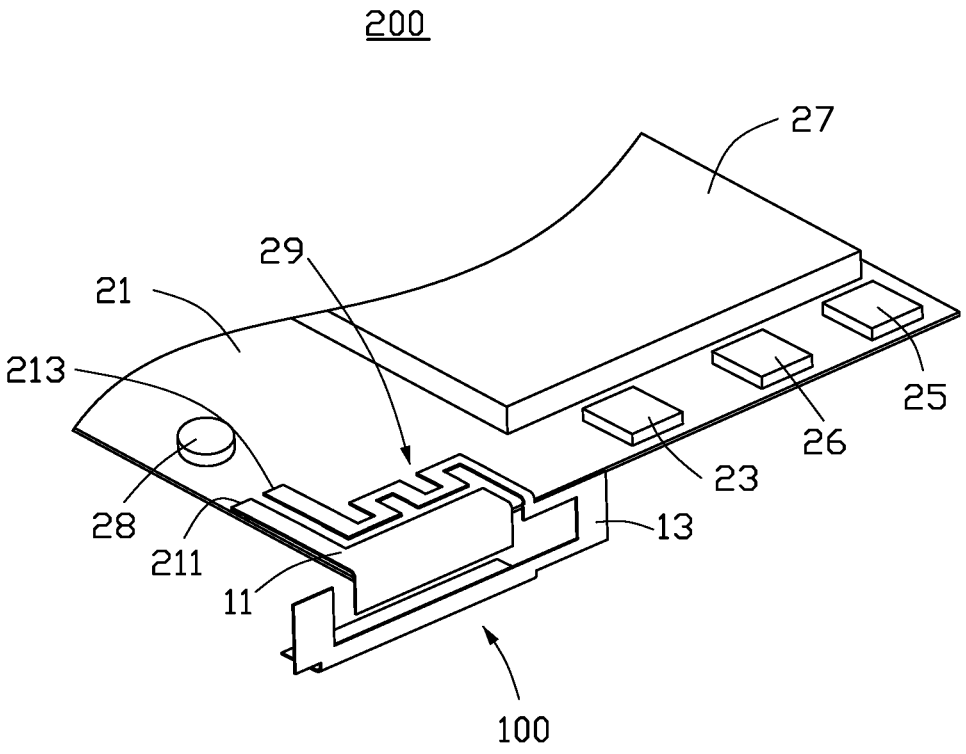
FIG. 1 is an isometric view of an embodiment of a wireless communication device using an antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

FIG. 1 is an embodiment of a wireless communication device 200 using an antenna structure 100. The wireless communication device 200 can be, for example, a mobile phone or a personal digital assistant. The antenna structure 100 can receive and transmit wireless signals.

The wireless communication device 200 further includes a substrate 21 and at least one electronic element. In this embodiment, the substrate 21 may be a printed circuit board (PCB) made of a dielectric material, such as, epoxy resin glass fiber (FR4) or the like. The substrate 21 includes a feed point 211 and a ground point 213. The feed point 211 is configured to supply current to the antenna structure 100. The ground point 213 is configured for grounding the antenna structure 100.

The wireless communication device 200 may include at least five electronic elements; for example, a first electronic element 23, a second electronic element 25, a third electronic element 26, a fourth electronic element 27, and a fifth electronic element 28.

The first electronic element 23 may be a speaker. The second electronic element 25 may be a Universal Serial Bus (USB) module. The third electronic element 26 may be a microphone. The first electronic element 23, the second electronic element 25, and the third electronic element 26 are all positioned at one end of the substrate 21 and spaced apart from each other. The third electronic element 26 is positioned between the first electronic element 23 and the second electronic element 25.

The fourth electronic element 27 may be a battery and positioned at a side of the substrate 21 adjacent to the first electronic element 23, the second electronic element 25, and the third electronic element 26. The fifth electronic element 28 may be a vibrator and positioned at another side of the substrate 21 facing towards the fourth electronic element 27.

The first electronic element 23, the second electronic element 25, the third electronic element 26, the fourth electronic element 27, and the fifth electronic element 28 cooperatively form a receiving area 29. The receiving area 29 is configured to receive the antenna structure 100. In one embodiment, the receiving area 29 is positioned at a left corner of the wireless communication device 200. The feed point 211 and the ground point 213 are positioned within the receiving area 29 and spaced apart from each other.

Figure 2:
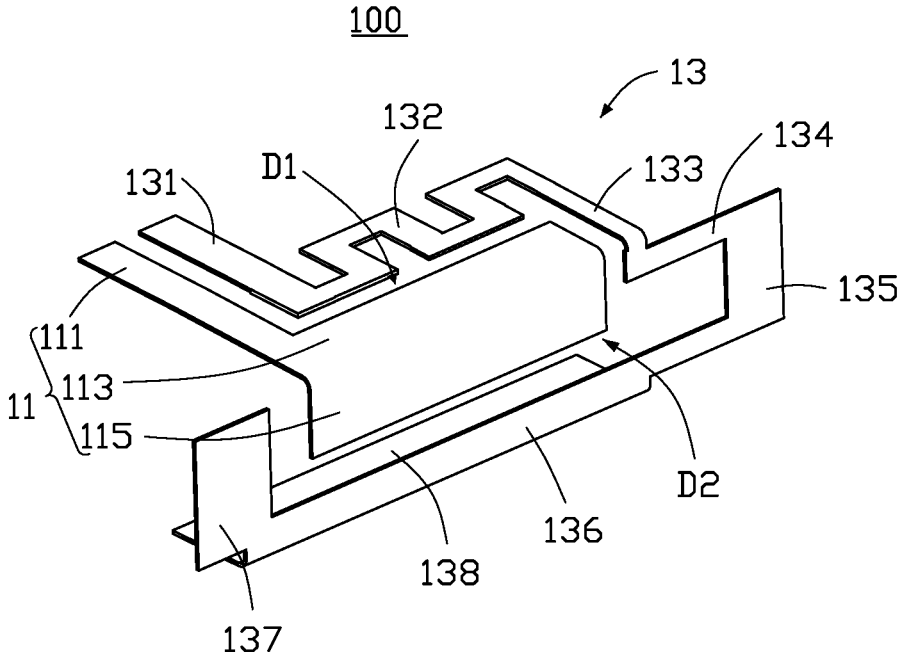
FIG. 2 is an isometric view of the antenna structure of FIG. 1.

In FIG. 2, the antenna structure 100 is made of metallic material or flexible printed circuit (FPC). The antenna structure 100 includes a radiating portion 11 and a coupling portion 13. The radiating portion 11 is electrically connected to the feed point 211. The coupling portion 13 is electrically connected to the ground point 213. The coupling portion 13 is spaced apart from the radiating portion 11 and forms a coupling-feed structure with the radiating portion 11.

The radiating portion 11 includes a feed section 111, a first radiating section 113, and a second radiating section 115. The feed section 111 is planar and positioned at a first plane. The feed section 111 is substantially rectangular. The feed section 111 is electrically connected to the feed point 211 and extends in a direction away from the fifth electronic element 28 and towards an end of the substrate 21.

The first radiating section 113 is substantially rectangular and coplanar with the feed section 111. One end of the first radiating section 113 is electrically connected to an end of the feed section 111 spaced away from the feed point 211. Another end of the first radiating section 113 extends in a direction perpendicular to the feed section 111 and towards the first electronic element 23. The first radiating section 113 and the feed section 111 cooperatively form an L-shaped structure.

The second radiating section 115 is planar and positioned at a second plane perpendicular to the first plane, in which the feed section 111 is positioned. The second radiating section 115 is substantially rectangular and perpendicularly connected to one side of the first radiating section 113 spaced away from the feed section 111.

The coupling portion 13 includes a ground section 131, a first coupling section 132, a second coupling section 133, a third coupling section 134, a fourth coupling section 135, a fifth coupling section 136, a sixth coupling section 137, and a seventh coupling section 138 connected in series and in that order.

The ground section 131 is substantially rectangular and coplanar with the feed section 111. That is, the ground section 131 is positioned at the first plane. One end of the ground section 131 is electrically connected to the ground point 213, and extends in a direction parallel to the feed section 111 and towards the end of the substrate 21.

The first coupling section 132 may be a planar and meandering sheet coplanar with the ground section 131. In this embodiment, the first coupling section 132 is substantially a square-wave shape. Two ends of the first coupling section 132 are respectively connected to the ground section 131 and the second coupling section 133. In other embodiments, the first coupling section 132 may be other than a square-wave shape, and can be in other shapes. In this embodiment, the first coupling section 132 is spaced apart from the first radiating section 113. A first distance D1 is defined between the first coupling section 132 and the first radiating section 113.

The second coupling section 133 is substantially a planar strip and coplanar with the first coupling section 132. One end of the second coupling section 133 is electrically connected to an end of the first coupling section 132 spaced away from the ground section 131. Another end of the second coupling section 133 extends in a direction parallel to the feed section 111 and towards the end of the substrate 21, and ends at a side collinear with one side of the first radiating section 113.

The third coupling section 134, the fourth coupling section 135, the fifth coupling section 136, and the sixth coupling section 137 are all planar and coplanar with the second radiating section 115. That is, the third coupling section 134, the fourth coupling section 135, the fifth coupling section 136, and the sixth coupling section 137 are all positioned at the second plane. The third coupling section 134 is substantially rectangular. The third coupling section 134 is perpendicularly connected to the another end of the second coupling section 133 spaced away from the first coupling section 132 and extends in a direction away from the second radiating section 115.

The fourth coupling section 135 is substantially rectangular. One end of the fourth coupling section 135 is perpendicularly connected to an end of the third coupling section 134 spaced away from the second coupling section 133 to form an L-shaped structure with the third coupling section 134.

The fifth coupling section 136 is substantially rectangular. One end of the fifth coupling section 136 is perpendicularly connected to an end of the fourth coupling section 135 spaced away from the third coupling section 134. Another end of the fifth coupling section 136 extends adjacent to one side of the second radiating section 115 and in a direction parallel to the third coupling section 134, and ends at a side passing over the second radiating section 115. In this embodiment, the fifth coupling section 136 is spaced apart from the second radiating section 115. A second distance D2 is defined between the fifth coupling section 136 and the second radiating section 115.

The sixth coupling section 137 is substantially rectangular. One end of the sixth coupling section 137 is perpendicularly connected to the another end of the fifth coupling section 136 spaced away from the fourth coupling section 135. Another end of the sixth coupling section 137 extends adjacent to another side of the second radiating section 115 and in a direction parallel to the fourth coupling section 135. In this embodiment, the fourth coupling section 135 and the sixth coupling section 137 are positioned at one side of the fifth coupling section 136 adjacent to the second radiating section 115, so that the fourth coupling section 135, the six coupling section 137, and the fifth coupling section 136 cooperatively form a U-shaped structure.

The seventh coupling section 138 is planar and positioned at a plane parallel to the first plane. That is, the seventh coupling section 138 is positioned at a third plane. The seventh coupling section 138 is substantially rectangular. One end of the seventh coupling section 138 is perpendicularly connected to one side of the fifth coupling section 136 spaced away from the fourth coupling section 135 and the sixth coupling section 137. Another end of the seventh coupling section 138 extends parallel to the ground section 131 to form an L-shaped structure with the fifth coupling section 136.

When the feed point 211 supplies current, the current flows through the radiating portion 11 and is then coupled to the coupling portion 13 through the first distance D1 and the second distance D2. Afterwards, the current from the coupling portion 13 is grounded through the ground point 213. Accordingly, the radiating portion 11 and the coupling portion 13 cooperatively form a coupling-feed antenna to excite corresponding resonant modes for generating radiation signals in corresponding frequency bands.

In this embodiment, the radiating portion 11 mainly excites a first resonant mode for generating radiation signals in a first frequency band. The coupling portion 13 mainly excites a second resonant mode for generating radiation signals in a second frequency band. In addition, the coupling portion 13 further generates a second harmonic frequency in the second resonant mode, thereby exciting a third resonant mode for generating radiation signals in a third frequency band.

In this embodiment, the first resonant mode may be a Long Term Evolution Advanced (LTE-A) middle frequency resonant mode. The second resonant mode may be a LTE-A low frequency resonant mode. The third resonant mode may be a LTE-A high frequency resonant mode. Frequencies of the first frequency band are higher than frequencies of the second frequency band. Frequencies of the third frequency band are higher than frequencies of the first frequency band. The first frequency band and the third frequency band are LTE-A middle and high frequency bands. Frequencies of the first frequency band and the third frequency band approximately range from 1710 MHz to 2690 MHz. The second frequency band may be a LTE-A low frequency band. Frequencies of the second frequency band approximately range from 700 MHz to 960 MHz.

Figure 3:
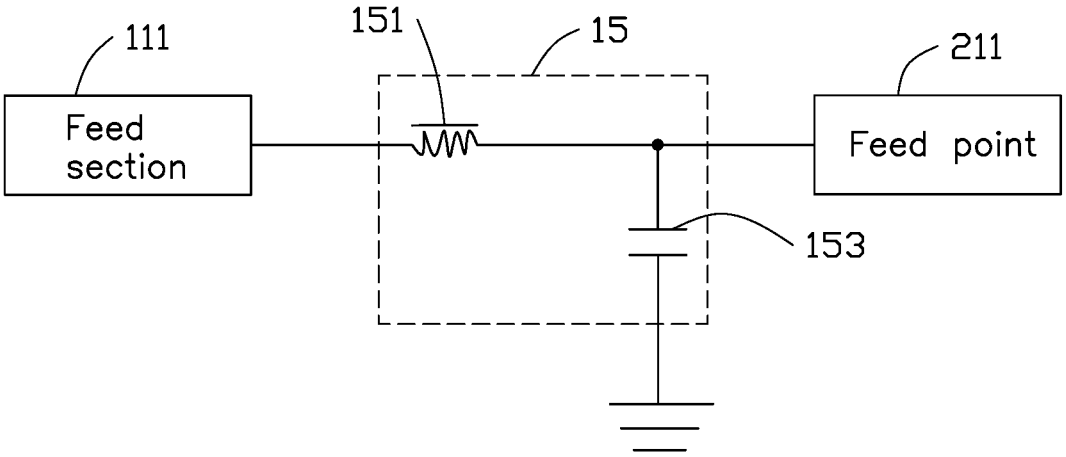
FIG. 3 is a circuit diagram of a matching circuit of the antenna structure of FIG. 1.

In FIG. 1 and FIG. 3, the antenna structure 100 further includes a matching circuit 15. The matching circuit 15 is disposed on the substrate 21. One end of the matching circuit 15 is electrically connected to the feed point 211. Another end of the matching circuit 15 is electrically connected to the feed section 111 of the radiating portion 11. The matching circuit 15 is configured for impedance matching the antenna structure 100.

In this embodiment, the matching circuit 15 includes a first matching element 151 and a second matching element 153. One end of the first matching element 151 is electrically connected to the feed point 211. Another end of the first matching element 151 is electrically connected to the feed section 111 of the radiating portion 11. One end of the second matching element 153 is electrically connected between the feed point 211 and the first matching element 151. Another end of the second matching element 153 is grounded.

In this embodiment, the first matching element 151 may be an inductor. The second matching element 153 may be a capacitor. An inductance value of the first matching element 151 is about 1 nH. A capacitance value of the second matching element 153 is about 1 pF. In other embodiments, the first matching element 151 and the second matching element 153 may be other than inductors and capacitors, and can be other impedance elements or combinations of elements.

Figure 4:
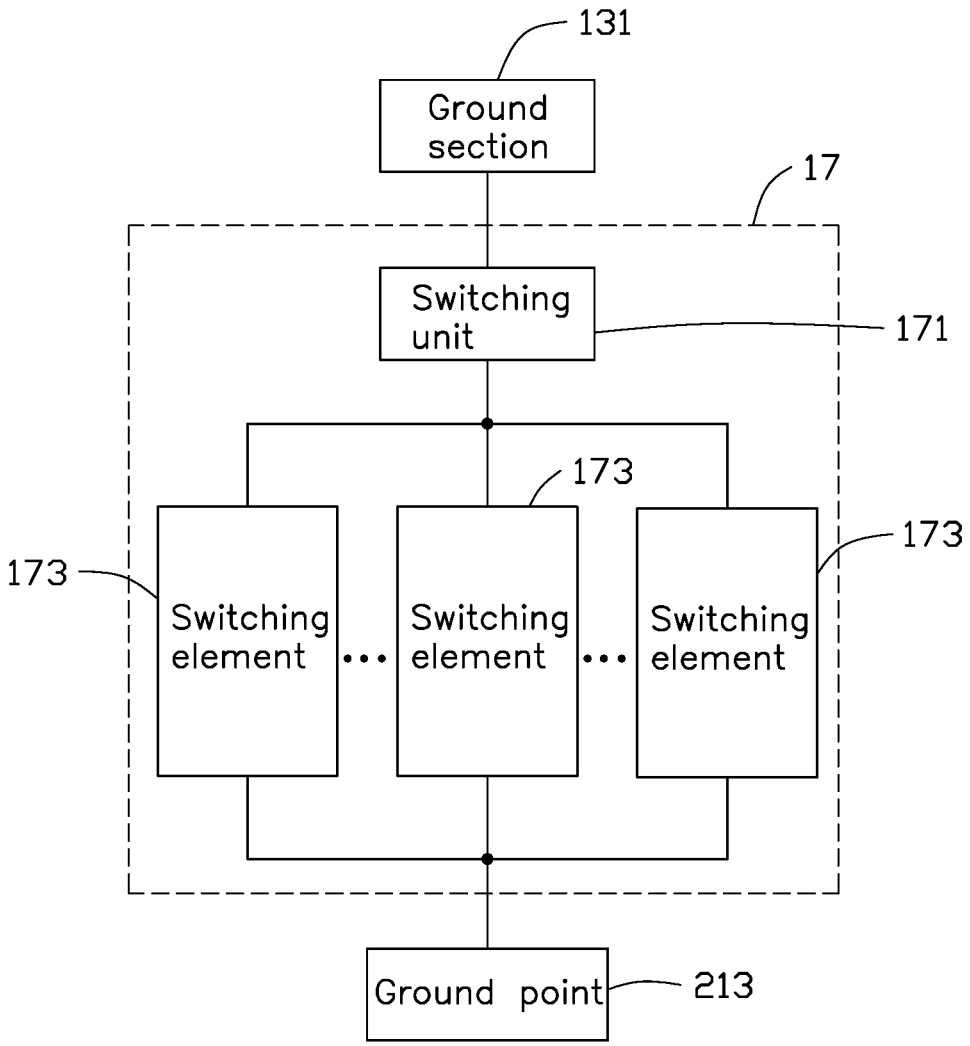
FIG. 4 is a circuit diagram of a switching circuit of the antenna structure of FIG. 1.

In FIG. 1 and FIG. 4, the antenna structure 100 further includes a switching circuit 17. The switching circuit 17 is disposed on the substrate 21. One end of the switching circuit 17 is electrically connected to the ground section 131 of the coupling portion 13. Another end of the switching circuit 17 is electrically connected to the ground point 213 to be grounded. The switching circuit 17 is configured to change the frequencies of the second frequency band, that is, the low frequency band of the antenna structure 100.

The switching circuit 17 may include a switching unit 171 and a plurality of switching elements 173. The switching unit 171 is electrically connected to the ground section 131 of the coupling portion 13. Each of the switching elements 173 can be an inductor, a capacitor, or a combination of the inductor and the capacitor. The switching elements 173 are connected in parallel to each other. One end of each switching element 173 is electrically connected to the switching unit 171. The other end of each switching element 173 is electrically connected to the ground point 213 to be grounded.

The coupling portion 13 can be switched to connect with different switching elements 173 through switching of the switching unit 171. Since each switching element 173 has a different impedance, frequencies of the low frequency band, i.e. the second frequency band, of the antenna structure 100 can be changed through the switching of the switching unit 171.

For example, the switching circuit 17 may include four switching elements 173. The four switching elements 173 are a 0 ohm resistor (that is, the switching element 173 is at a short-circuit state), an inductor having an inductance value of about 2.2 nH, an inductor having an inductance value of about 4.3 nH, and an inductor having an inductance value of about 6.8 nH, respectively.

When the switching of the switching unit 171 is controlled to connect with the 0 ohm resistor, the antenna structure 100 can operate at a frequency band of LTE-A band 8 (880 MHz-960 MHz). When the switching of the switching unit 171 is controlled to connect with the switching element 173 having an inductance value of about 2.2 nH, the antenna structure 100 can operate at a frequency band of LTE-A band 5 (824 MHz-894 MHz). When the switching of the switching unit 171 is controlled to connect with the switching element 173 having an inductance value of about 4.3 nH, the antenna structure 100 can operate at a frequency band of LTE-A band 20 (791 MHz-862 MHz). When the switching of the switching unit 171 is controlled to connect with the switching element 173 having an inductance value of about 6.8 nH, the antenna structure 100 can operate at a frequency band of LTE-A band 17 (704 MHz-746 MHz). That is, through the switching control of the switching unit 171, a low frequency band of the antenna structure 100 can cover a range from 700 MHz to 960 MHz.

Figure 5:
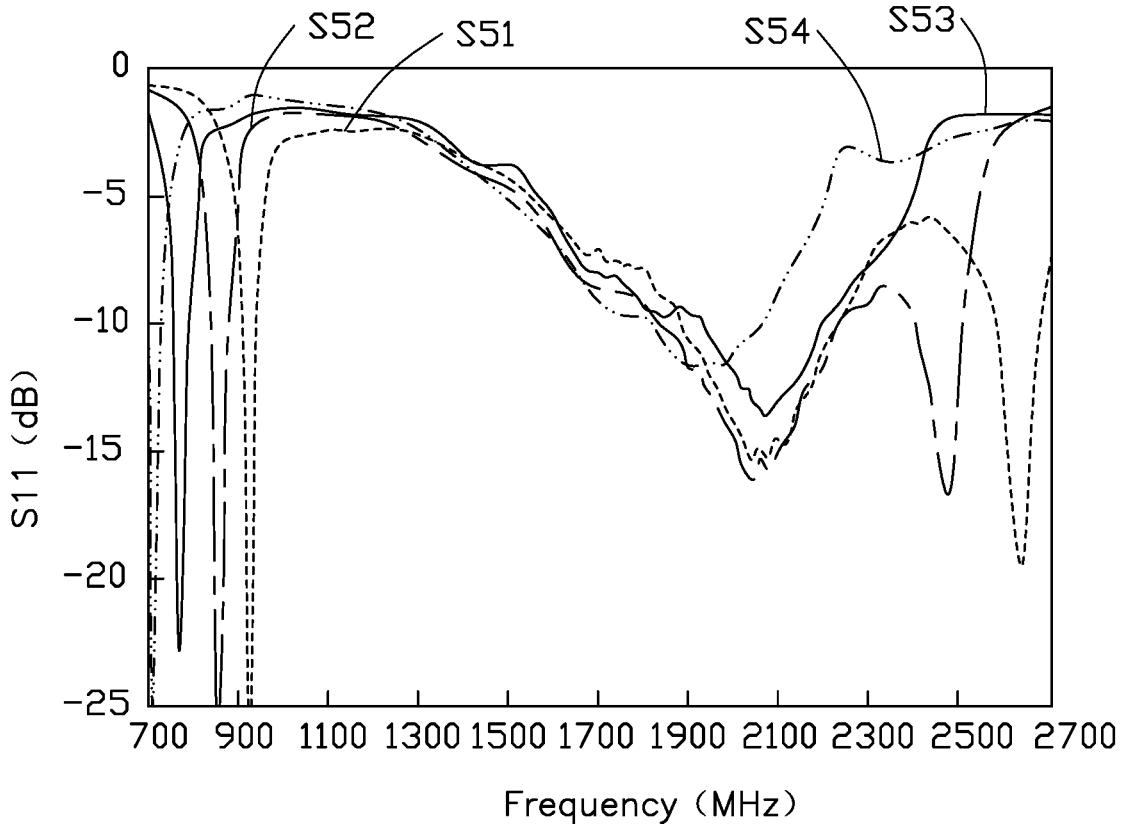
FIG. 5 is a scattering parameter graph of the antenna structure of FIG. 1.

FIG. 5 is a scattering parameter graph of the antenna structure 100. Curve S51 represents scattering parameters of the antenna structure 100 when the switching of the switching unit 171 is controlled to connect with the 0 ohm resistor. Curve S52 represents scattering parameters of the antenna structure 100 when the switching of the switching unit 171 is controlled to connect with the switching element 173 having an inductance value of about 2.2 nH. Curve S53 represents scattering parameters of the antenna structure 100 when the switching of the switching unit 171 is controlled to connect with the switching element 173 having an inductance value of about 4.3 nH. Curve S54 represents scattering parameters of the antenna structure 100 when the switching of the switching unit 171 is controlled to connect with the switching element 173 having an inductance value of about 6.8 nH.

As shown by curves S51-S54, through the switching control of the switching unit 171, the low frequency band of the antenna structure 100 can be effectively adjusted. Meanwhile, the middle frequency band is not affected when the low frequency band is adjusted. Additionally, since the third frequency band includes second harmonic frequencies of the second frequency band, the switching circuit 17 can also be configured to adjust the high frequency band, i.e. the third frequency band, of the antenna structure 100.

Figure 6:
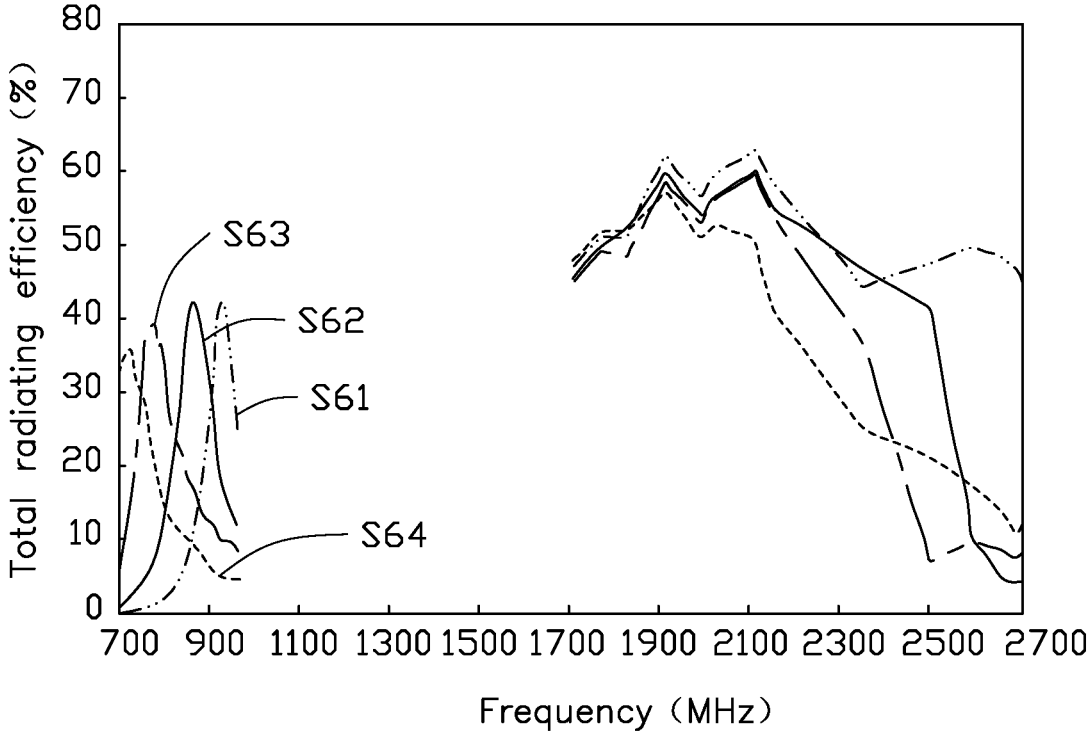
FIG. 6 is a total radiating efficiency graph of the antenna structure of FIG. 1.

FIG. 6 is a total radiating efficiency graph of the antenna structure 100. Curve S61 represents a total radiating efficiency of the antenna structure 100 when the switching of the switching unit 171 is controlled to connect with the 0 ohm resistor. Curve S62 represents a total radiating efficiency of the antenna structure 100 when the switching of the switching unit 171 is controlled to connect with the switching element 173 having an inductance value of about 2.2 nH. Curve S63 represents a total radiating efficiency of the antenna structure 100 when the switching of the switching unit 171 is controlled to connect with the switching element 173 having an inductance value of about 4.3 nH. Curve S64 represents a total radiating efficiency of the antenna structure 100 when the switching of the switching unit 171 is controlled to connect with the switching element 173 having an inductance value of about 6.8 nH.

As shown by curves S61-S64, a low frequency band of the antenna structure 100 can cover a range from 700 MHz to 960 MHz. A total radiating efficiency of the antenna structure 100 at the low frequency band may be about from 32% to 42%. The middle and high frequency bands of the antenna structure 100 can cover a range from 1710 MHz to 2690 MHz. A total radiating efficiency of the antenna structure 100 at the middle and high frequency bands may be about from 45% to 63%. Therefore, the antenna structure 100 has a good radiating performance in the effective frequency bands and meets the antenna design requirements.

Figure 7:
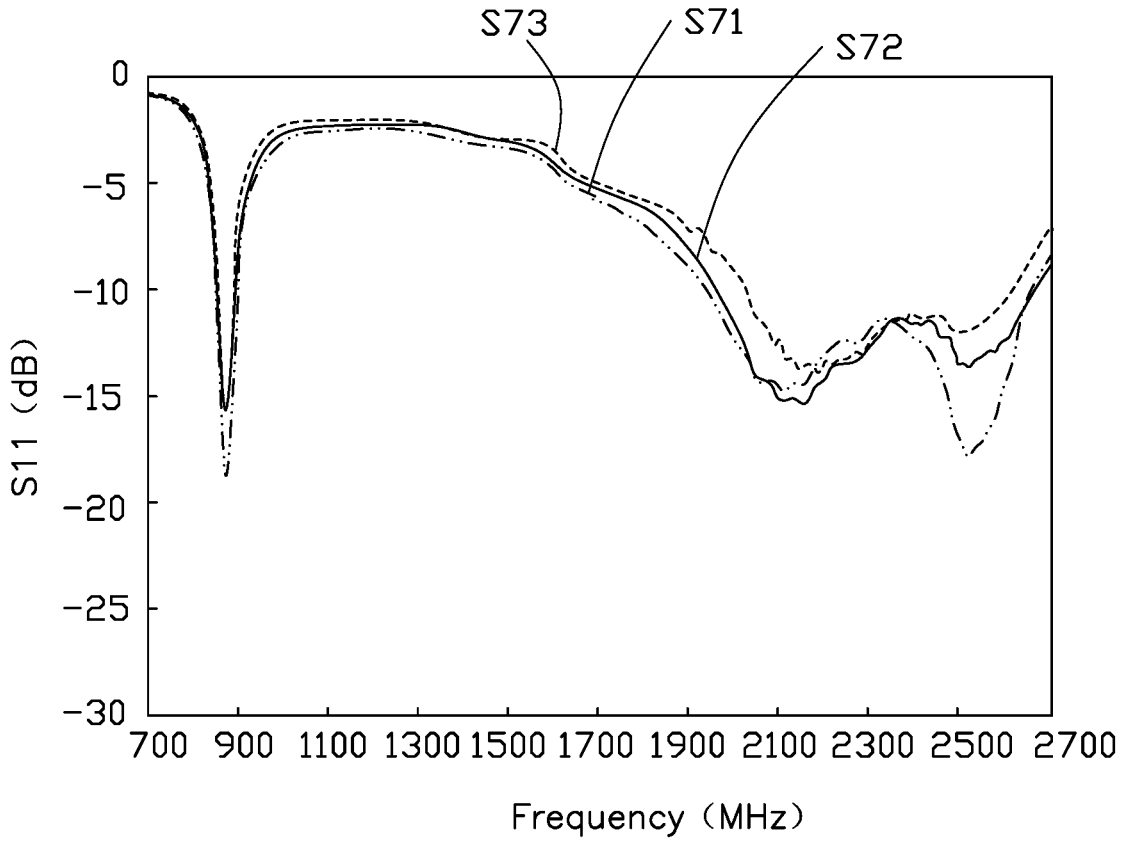
FIG. 7 is a scattering parameter graph of the antenna structure, for different values of a first distance of FIG. 2.

FIG. 7 is a scattering parameter graph of the antenna structure 100, for different values of first distance D1. Curve S71 represents scattering parameters of the antenna structure 100 when the first distance D1 is about 0.5 mm. Curve S72 represents scattering parameters of the antenna structure 100 when the first distance D1 is about 1 mm. Curve S73 represents scattering parameters of the antenna structure 100 when the first distance D1 is about 1.5 mm.

Figure 8:
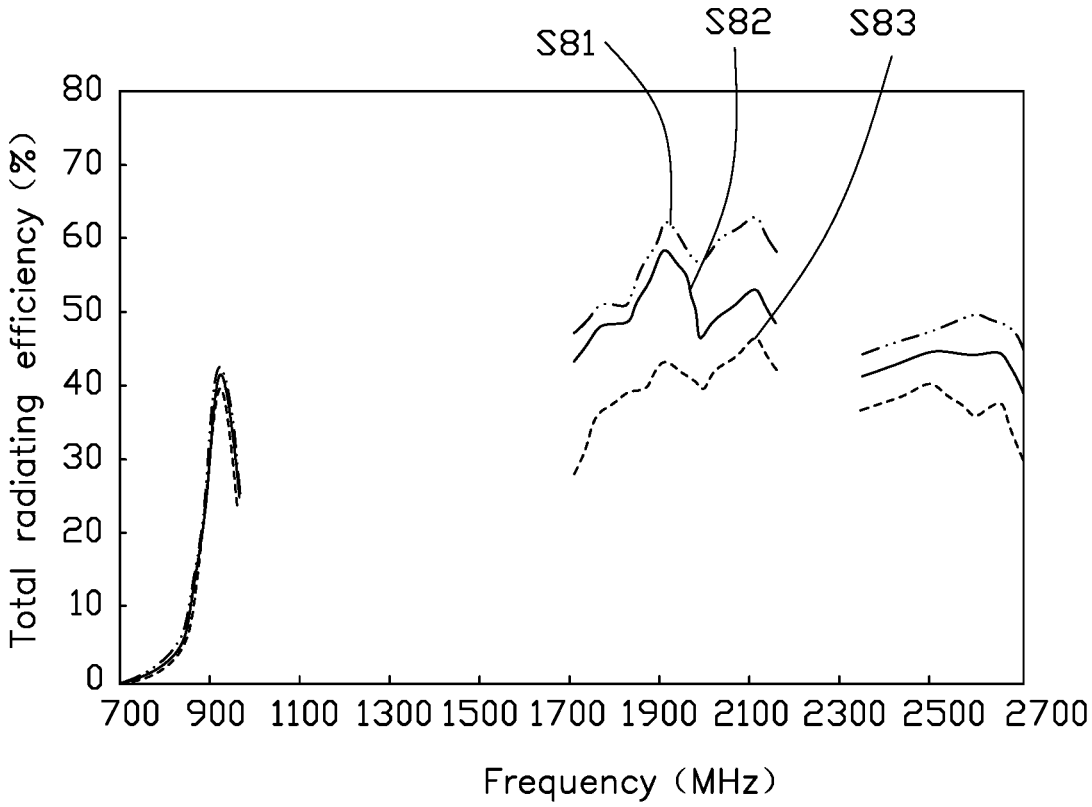
FIG. 8 is a total radiating efficiency graph of the antenna structure, for different values of a first distance of FIG. 2.

FIG. 8 is a total radiating efficiency graph of the antenna structure 100, for different values of first distance D1. Curve S81 represents a total radiating efficiency of the antenna structure 100 when the first distance D1 is about 0.5 mm. Curve S82 represents a total radiating efficiency of the antenna structure 100 when the first distance D1 is about 1 mm. Curve S83 represents a total radiating efficiency of the antenna structure 100 when the first distance D1 is about 1.5 mm.

Figure 9:
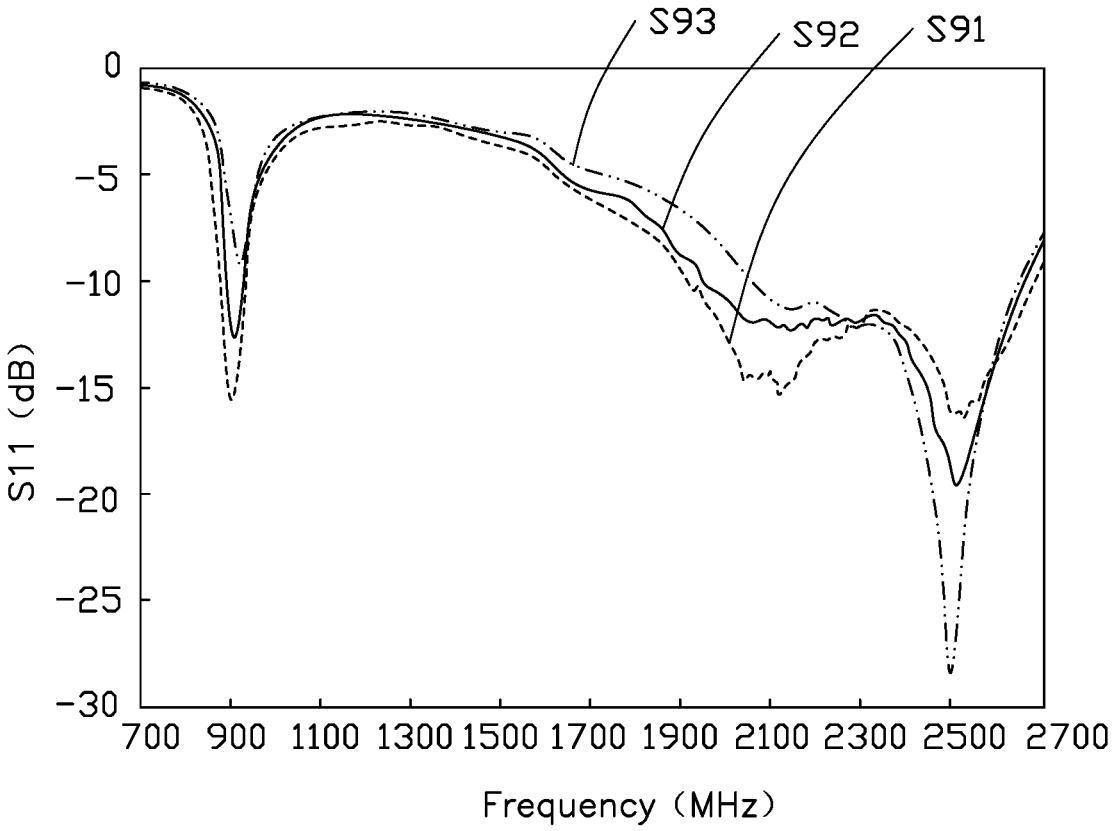
FIG. 9 is a scattering parameter graph of the antenna structure, for different values of a second distance of FIG. 2.

FIG. 9 is a scattering parameter graph of the antenna structure 100, for different values of the second distance D2. Curve S91 represents scattering parameters of the antenna structure 100 when the second distance D2 is about 1 mm. Curve S92 represents scattering parameters of the antenna structure 100 when the second distance D2 is about 1.5 mm. Curve S93 represents scattering parameters of the antenna structure 100 when the second distance D2 is about 2 mm.

Figure 10:
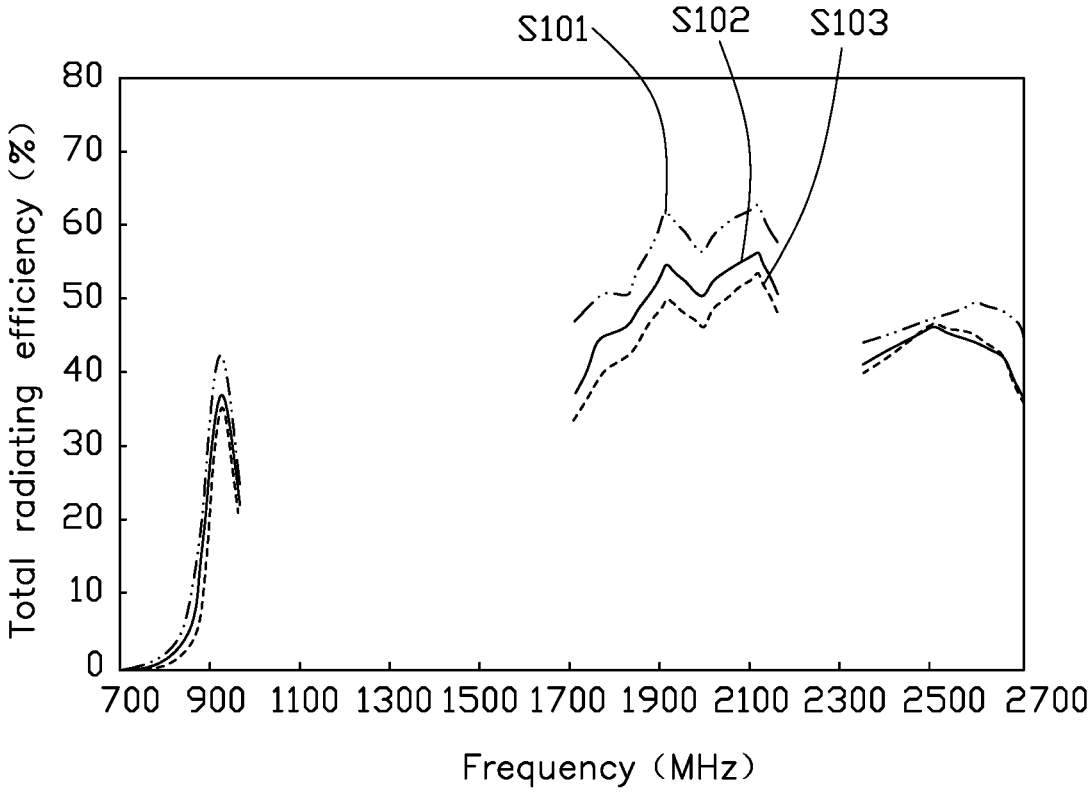
FIG. 10 is a total radiating efficiency graph of the antenna structure, for different values of a second distance of FIG. 2.

FIG. 10 is a total radiating efficiency graph of the antenna structure 100, for different values of the second distance D2. Curve S101 represent a total radiating efficiency of the antenna structure 100 when the second distance D2 is about 1 mm. Curve S102 represent a total radiating efficiency of the antenna structure 100 when the second distance D2 is about 1.5 mm. Curve S103 represent a total radiating efficiency of the antenna structure 100 when the second distance D2 is about 2 mm.

As shown from FIG. 7 to FIG. 10, by varying the first distance D1 and the second distance D2, a bandwidth of the antenna structure 100 can be effectively adjusted.

As described above, the antenna structure 100 includes the radiating portion 11 and the coupling portion 13. The radiating portion 11 excites the first resonant mode for generating radiation signals in the LTE-A middle frequency band. The coupling portion 13 excites the second and third resonant modes for generating radiation signals in the LTE-A low and high frequency bands. The wireless communication device 200 can use the radiating portion 11 and the coupling portion 13, through carrier aggregation (CA) technology of LTE-A, to receive or send wireless signals at multiple different frequency bands simultaneously for increasing a transmission bandwidth, that is, to realize 3CA.

The antenna structure 100 has a simple structure and may completely cover multiple system bandwidths required by current communication systems. For example, the low frequency band of the antenna structure 100 can cover a range from 700 MHz to 960 MHz, and the middle and high frequency bands of the antenna structure 100 can cover a range from 1710 MHz to 2690 MHz, which meets the antenna design requirements.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a radiating portion, electrically connected to a feed point for feeding current; and a coupling portion, electrically connected to a ground point to be grounded;

wherein the coupling portion is spaced apart from the radiating portion, the radiating portion excites a first resonant mode for generating radiation signals in a first frequency band, the current flowing through the radiating portion is coupled to the coupling portion, whereby the coupling portion excites a second resonant mode and a third resonant mode for generating radiation signals in a second frequency band and a third frequency band;

wherein frequencies of the first frequency band are higher than frequencies of the second frequency band, and frequencies of the third frequency band are higher than frequencies of the first frequency band;

wherein the radiating portion is positioned at a first plane and a second plane, the second plane is perpendicular to the first plane;

wherein the coupling portion comprises a first coupling portion and a second coupling portion, the first coupling portion is positioned at the first plane and is square-wave shaped, and wherein the radiating portion comprises a feed section, a first radiating section, and a second radiating section, the feed section and the first radiating section are planar and positioned at the first plane, and the second radiating section is planar and positioned at the second plane; and wherein the feed section is electrically connected to the feed point, the first radiating section is perpendicularly connected to an end of the feed section spaced away from the feed point, and the second radiating section is perpendicularly connected to one side of the first radiating section spaced away from the feed section.

2. The antenna structure of claim 1, wherein the coupling portion comprises a ground section, a first coupling section, a second coupling section, a third coupling section, a fourth coupling section, a fifth coupling section, a sixth coupling section, and a seventh coupling section connected in series and in that order; wherein the ground section is electrically connected to the ground point and extends in a direction parallel to the feed section, the first coupling section forms the first coupling portion, two ends of the first coupling section are respectively connected to the ground section and the second coupling section; wherein one end of the second coupling section is electrically connected to an end of the first coupling section spaced away from the ground section, and another end of the second coupling section extends in a direction parallel to the feed section and ends at a side collinear with one side of the first radiating section; wherein the third coupling section, the fourth coupling section, the fifth coupling section, and the sixth coupling section form the second coupling portion, the third coupling section is perpendicularly connected to one end of the second coupling section spaced away from the first coupling section and extends in a direction away from the second radiating section; wherein the fourth coupling section is perpendicularly connected to the third coupling section spaced away from the second coupling section to form an L-shaped structure with the third coupling section; wherein one end of the fifth coupling section is perpendicularly connected to one end of the fourth coupling section spaced away from the third coupling section, and another end of the fifth coupling section extends adjacent to one side of the second radiating section and in a direction parallel to the third coupling section and ends at a side passing over the second radiating section; wherein the sixth coupling section is perpendicularly connected to the another end of the fifth coupling section spaced away from the fourth coupling section and extends adjacent to another side of the second radiating section and in a direction parallel to the fourth coupling section; and wherein one end of the seventh coupling section is perpendicularly connected to one side of the fifth coupling section spaced away from the fourth coupling section and the sixth coupling section, and another end of the seventh coupling section extends parallel to the ground section to form an L-shaped structure with the fifth coupling section.

3. The antenna structure of claim 2, wherein the ground section, the first coupling section, and the second coupling section are positioned at the first plane; wherein the third coupling section, the fourth coupling section, the fifth coupling section, and the sixth coupling section are positioned at the second plane; and wherein the seventh coupling section is positioned at a third plane parallel to the first plane.

4. The antenna structure of claim 2, wherein the first coupling section is spaced apart from the first radiating section, and a first distance is defined between the first coupling section and the first radiating section; wherein the fifth coupling section is spaced apart from the second radiating section, and a second distance is defined between the fifth coupling section and the second radiating section; and wherein a bandwidth of the antenna structure is changed according to the first distance and the second distance.

5. The antenna structure of claim 1, further comprising a matching circuit for impedance matching the antenna structure, wherein the matching circuit comprises a first matching element and a second matching element, one end of the first matching element is electrically connected to the feed point, another end of the first matching element is electrically connected to the feed section of the radiating portion; and wherein one end of the second matching element is electrically connected between the feed point and the first matching element, and another end of the second matching element is grounded.

6. The antenna structure of claim 2, further comprising a switching circuit, wherein the switching circuit comprises a switching unit and a plurality of switching elements, the switching unit is electrically connected to the ground section of the coupling portion, the switching elements are connected in parallel to each other, one end of each switching element is electrically connected to the switching unit and the other end of each switching element is grounded; and wherein through switching of the switching unit, the coupling portion is switched to connect with different switching elements for changing the second frequency band.

7. The antenna structure of claim 1, wherein the radiating portion and the coupling portion are configured to receive or send wireless signals at multiple frequency bands simultaneously through a carrier aggregation (CA) technology of Long Term Evolution Advanced (LTE-A).

8. A wireless communication device comprising:

a substrate, comprising a feed point and a ground point; and an antenna structure, comprising:

a radiating portion, electrically connected to the feed point for feeding current; and a coupling portion, electrically connected to the ground point to be grounded;

wherein the coupling portion is spaced apart from the radiating portion, the radiating portion excites a first resonant mode for generating radiation signals in a first frequency band, the current flowing through the radiating portion is coupled to the coupling portion, whereby the coupling portion excites a second resonant mode and a third resonant mode for generating radiation signals in a second frequency band and a third frequency band;

wherein frequencies of the first frequency band are higher than frequencies of the second frequency band, and frequencies of the third frequency band are higher than frequencies of the first frequency band;

wherein the radiating portion is positioned at a first plane and a second plane, the second plane is perpendicular to the first plane;

wherein the coupling portion comprises a first coupling portion and a second coupling portion, the first coupling portion is positioned at the first plane and is square-wave shaped, and wherein the radiating portion comprises a feed section, a first radiating section, and a second radiating section, the feed section and the first radiating section are planar and positioned at the first plane, and the second radiating section is planar and positioned at the second plane; and wherein the feed section is electrically connected to the feed point, the first radiating section is perpendicularly connected to an end of the feed section spaced away from the feed point, and the second radiating section is perpendicularly connected to one side of the first radiating section spaced away from the feed section.

9. The wireless communication device of claim 8, further comprising a speaker, a Universal Serial Bus (USB) module, a microphone, a battery, and a vibrator; wherein the speaker, the USB module, and the microphone are positioned at one end of the substrate and are spaced apart from each other; wherein the battery and the vibrator are positioned at two sides of the substrate and spaced apart from each other; and wherein the speaker, the USB module, the microphone, the battery, and the vibrator together form a receiving area on the substrate for receiving the antenna structure.

10. The wireless communication device of claim 8, wherein the coupling portion comprises a ground section, a first coupling section, a second coupling section, a third coupling section, a fourth coupling section, a fifth coupling section, a sixth coupling section, and a seventh coupling section connected in series and in that order; wherein the ground section is electrically connected to the ground point and extends in a direction parallel to the feed section, the first coupling section forms the first coupling portion, two ends of the first coupling section are respectively connected to the ground section and the second coupling section; wherein one end of the second coupling section is electrically connected to an end of the first coupling section spaced away from the ground section, and another end of the second coupling section extends in a direction parallel to the feed section and ends at a side collinear with one side of the first radiating section; wherein the third coupling section, the fourth coupling section, the fifth coupling section, and the sixth coupling section form the second coupling portion, the third coupling section is perpendicularly connected to one end of the second coupling section spaced away from the first coupling section and extends in a direction away from the second radiating section; wherein the fourth coupling section is perpendicularly connected to the third coupling section spaced away from the second coupling section to form an L-shaped structure with the third coupling section; wherein one end of the fifth coupling section is perpendicularly connected to one end of the fourth coupling section spaced away from the third coupling section, and another end of the fifth coupling section extends adjacent to one side of the second radiating section and in a direction parallel to the third coupling section and ends at a side passing over the second radiating section; wherein the sixth coupling section is perpendicularly connected to the another end of the fifth coupling section spaced away from the fourth coupling section and extends adjacent to another side of the second radiating section and in a direction parallel to the fourth coupling section; and wherein one end of the seventh coupling section is perpendicularly connected to one side of the fifth coupling section spaced away from the fourth coupling section and the sixth coupling section, and another end of the seventh coupling section extends parallel to the ground section to form an L-shaped structure with the fifth coupling section.

11. The wireless communication device of claim 10, wherein the ground section, the first coupling section, and the second coupling section are positioned at the first plane; wherein the third coupling section, the fourth coupling section, the fifth coupling section, and the sixth coupling section are positioned at the second plane; and wherein the seventh coupling section is positioned at a third plane parallel to the first plane.

12. The wireless communication device of claim 10, wherein the first coupling section is spaced apart from the first radiating section, and a first distance is defined between the first coupling section and the first radiating section; wherein the fifth coupling section is spaced apart from the second radiating section, and a second distance is defined between the fifth coupling section and the second radiating section; and a bandwidth of the antenna structure is changed according to the first distance and the second distance.

13. The wireless communication device of claim 8, wherein the antenna structure further comprises a matching circuit for impedance matching the antenna structure, the matching circuit comprises a first matching element and a second matching element, one end of the first matching element is electrically connected to the feed point, another end of the first matching element is electrically connected to the feed section of the radiating portion; and wherein one end of the second matching element is electrically connected between the feed point and the first matching element, and another end of the second matching element is grounded.

14. The wireless communication device of claim 10, wherein the antenna structure further comprises a switching circuit, the switching circuit comprises a switching unit and a plurality of switching elements, the switching unit is electrically connected to the ground section of the coupling portion, the switching elements are connected in parallel to each other, one end of each switching element is electrically connected to the switching unit and the other end of each switching element is grounded; and wherein through switching of the switching unit, the coupling portion is switched to connect with different switching elements for changing the second frequency band.

15. The wireless communication device of claim 8, wherein the wireless communication device uses the radiating portion and the coupling portion to receive or send wireless signals at multiple frequency bands simultaneously through a carrier aggregation (CA) technology of Long Term Evolution Advanced (LTE-A).

* * * * *